US006834575B2

(12) United States Patent
Manfreda

(10) Patent No.: US 6,834,575 B2
(45) Date of Patent: Dec. 28, 2004

(54) PISTON ASSEMBLY FOR A RADIAL PISTON HYDRAULIC MOTOR

(76) Inventor: Jurij Manfreda, Med ogradami 9a, 5000 Nova Gorica (SI)

( * ) Notice: Subject to any disclaimer, the term of this patent is extended or adjusted under 35 U.S.C. 154(b) by 121 days.

(21) Appl. No.: 10/221,948

(22) PCT Filed: Mar. 28, 2001

(86) PCT No.: PCT/SI01/00009

§ 371 (c)(1),
(2), (4) Date: Dec. 2, 2002

(87) PCT Pub. No.: WO01/81727

PCT Pub. Date: Nov. 1, 2001

(65) Prior Publication Data

US 2004/0003711 A1 Jan. 8, 2004

(30) Foreign Application Priority Data

Apr. 21, 2000 (SI) ..... P-200000105

(51) Int. Cl.[7] ..... F01B 1/06
(52) U.S. Cl. ..... 92/255; 92/58; 92/72
(58) Field of Search ..... 92/58, 72, 172, 92/255, 259

(56) References Cited

U.S. PATENT DOCUMENTS

| | | | | | |
|---|---|---|---|---|---|
| 3,982,843 | A | | 9/1976 | Sirek | |
| 4,747,339 | A | * | 5/1988 | Wusthof et al. | 92/148 |
| 5,081,906 | A | | 1/1992 | Lemaire et al. | |
| 5,090,295 | A | * | 2/1992 | Cunningham et al. | 91/491 |
| 5,391,059 | A | * | 2/1995 | Hallund | 417/273 |
| 5,794,582 | A | | 8/1998 | Horiuchi | |
| 5,979,295 | A | * | 11/1999 | Larker et al. | 92/58 |
| 6,276,261 | B1 | * | 8/2001 | Manfreda | 92/255 |

FOREIGN PATENT DOCUMENTS

| | | |
|---|---|---|
| FR | 2 368 619 | 5/1978 |
| GB | 1 484 014 | 8/1977 |
| GB | 2 064 700 A | 6/1981 |
| WO | WO 98/1472 | 4/1998 |
| WO | WO 98/14722 | 4/1998 |

* cited by examiner

*Primary Examiner*—Thomas E. Lazo
(74) *Attorney, Agent, or Firm*—Beem Patent Law Firm

(57) ABSTRACT

The invention refers to a piston assembly for a radial piston hydraulic motor. The essence of the solution lies in that a longitudinal axis (12) of a roller (11) substantially coincides with an axis through centre of gravity of a piston body (2). The roller is placed in a bed (10) of a bearing bush (6) which is located inside the piston (1) in a manner that the edges thereof slip through grooves (14) in the lower inner portion of the piston (1). The roller (1) being inserted this way is afterwards rotated in a certain angle, together with the bearing bush (6), thus, preventing the roller (11) from falling out of the piston (1).

8 Claims, 3 Drawing Sheets

PISTON ASSEMBLY FOR A RADIAL PISTON HYDRAULIC MOTOR

BACKGROUND OF THE INVENTION

1. Field of the Invention

The present invention relates to a piston assembly for a radial piston hydraulic motor.

2. Description of the Related Art

The above mentioned piston assembly is disclosed e.g. in GB 2,064,700, FR-A 2,368,619 and WO 98/14722. It has been found that none of the said solutions are satisfactory, neither in the sense of the production of an engine with minimum overall dimensions nor the minimum load of the piston assembly, nor in combination with each other.

BRIEF SUMMARY OF THE INVENTION

It is therefore the primary object of the present invention to propose a piston assembly for a radial piston hydraulic motor which will enable minimum overall dimensions with the maximum conversion of hydraulic energy into mechanical energy and vice versa, during the entire life span of the motor, and with the least amount of energy lost.

Another object of the present invention is to create a piston assembly where the surface pressure will be distributed as equally as possible over the surface of the portion of the piston which is in direct contact with the wall of the working cylinder.

Yet another object of the present invention is to create a piston assembly which is prevented from rotating about the longitudinal axis thereof.

According to the invention this problem is solved by a one-piece piston formed as a cylindrical body with a crown attached to it. The said piston crown has a variable diameter so that the outline thereof represents at least piecewise smoothly decreasing curve when observed in the direction away from the piston body and towards the middle thereof. The crown is preferably formed as a spherical segment, it may, however, comprise different shapes e.g. of a frustum of a cone. A bearing bush inserted into the said piston comprises a roller bed and a roller rotationally arranged in the said bed. The longitudinal axis of the roller essentially coincides with the transverse axis through centre of gravity of the cylindrical piston body. The inner portion of the piston body, which is situated below the longitudinal axis of the roller, is formed with a decreasing diameter in the direction away from the piston crown. In order to allow the roller to be placed into the bed of the bearing bush, the said inner portion of the piston body is provided with a number of grooves distributed circumferentially around the inner portion of the piston body. Said grooves extend from the lowermost edge of the piston longitudinally towards the piston crown. Moreover, said grooves coincide with the edges of the roller.

With such an arrangement of the roller with respect to the cylindrical piston body the surface pressure is distributed as equally as possible over the friction area of the piston, resulting in considerably lower wear of the surface of the piston which is in direct contact with the cylinder wall.

According to the invention, the bearing bush of the piston assembly is formed in a way that the portion thereof facing the piston crown is congruent with the inner surface and the roof of the piston, respectively. A bore is formed in the said cylindrical portion of the bearing bush, said bore extending perpendicularly to the longitudinal axis of the piston and is intended to receive the roller. The bearing bush is secured by means of an adhesive joint on the contact surfaces with the piston, against the rotation in an axial direction of the piston assembly.

The inner surface of the piston and/or the said inner portion of the piston body is preferably shaped spherically, said fictive sphere which forms the said spherical zone comprises a diameter which circumscribes the roller. In this way the bearing bush can still be placed inside the piston and, after the bearing bush and roller are rotated about the longitudinal axis of the piston, the roller is at the same time prevented from falling out of the piston.

The bearing bush and the roller therewith are secured against rotation about the longitudinal axis of the piston by means of an adhesive joint between the inner surface and the roof of the piston, respectively, and the bearing bush, the latter also being secured against longitudinal displacement.

In order to prevent the piston assembly from rotating about the longitudinal axis thereof, the piston crown and the bearing bush are provided with a receiving bore, extending in a longitudinal direction of the piston assembly, in which bore there is fixed a guide pin which, on the other hand, is guided with some play in a guide bore made in a body of the hydraulic motor. Here, the guide pin is formed with a longitudinal bore and a transverse bore, the latter lying outside the said receiving bore. The bearing bush is provided with a connecting bore mutually linking the roller bed and the lower i.e. base end of the receiving bore. The lubricant, i.e. a hydraulic oil in a given case, passes through the connecting bore into one or more of lubrication grooves provided in the roller bed of the bearing bush. This way an additional forced lubrication of the roller is facilitated.

The invention will be more readily understood on reading the following description with reference to the accompanying drawings, in which:

DETAILED DESCRIPTION OF THE INVENTION

Figure 1:
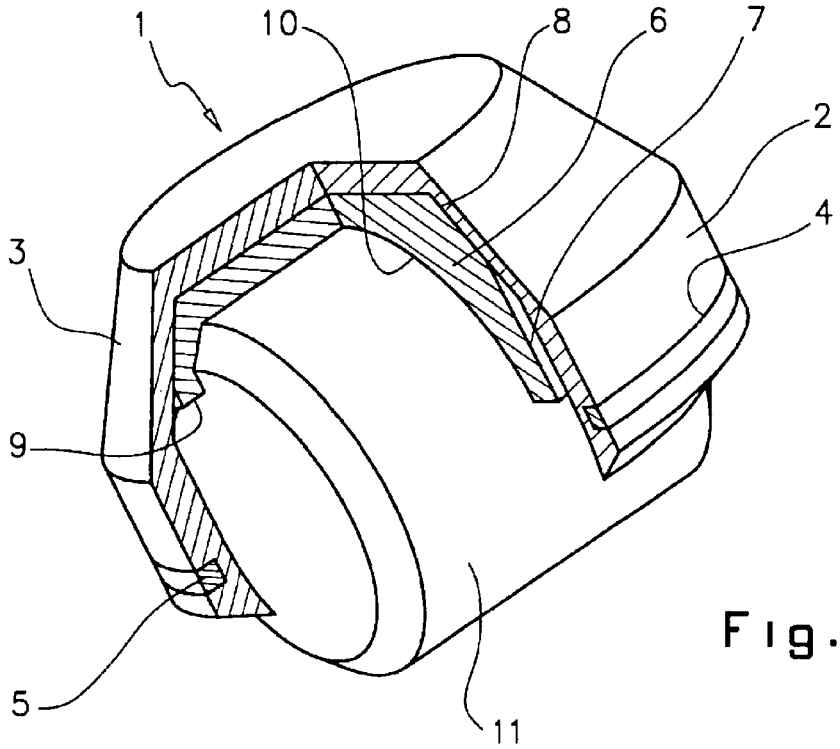
FIG. 1 is a perspective view of a partial cross-section of a piston assembly according to the invention.

The piston assembly for a radial piston hydraulic motor according to the invention comprises a piston 1 having a cylindrical piston body 2 and a piston crown 3 integrally associated therewith, which latter is formed with at least partially smoothly decreasing diameter, when observed in the direction away from the piston body 2, in a given case the said piston crown being a frustum of a cone. Moreover, a radially extending groove 4 is provided in the piston body 2 in which a piston ring 5 is placed. According to demand there could be provided more rings of the same kind, the said rings being spaced apart in a longitudinal direction of the piston 1. A bearing bush 6 is located in the piston 1, the lower portion of the said bush 6 being cylindrical and the top portion 8 thereof, i.e. that one facing the piston crown 3, is formed in a way to be congruent with the inner surface and the roof of the piston 1, respectively. The outside diameter of a cylindrical portion 7 of the bearing bush 6 is smaller than the inner diameter of the piston body 2 so that the bearing bush 6 can be easily inserted into the piston 1. Furthermore, the bearing bush 6 can be provided with a cylindrical through-bore 9, extending perpendicularly to the longitudinal axis thereof, the said bore 9 facilitates finishing a bed 10 for a roller 11. Here, the radius of the said through bore 9 is considerably smaller than the radius of the roller 11, and corresponds, in a given case, to the height of the cylindrical portion 7, the centre-line of said bore 9 lies substantially in the plane of the lower base of the bearing bush. The bed 10 of the roller 11 is finished coaxially with the through bore 9. In essence, the entire assembly piston 1—bearing bush 6—roller 11 is formed in a way that a longitudinal axis 12 of the roller 11 coincides with the transverse axis through centre of gravity of the cylindrical piston body 2.

An inner portion 13 of the piston body 2 located below the longitudinal axis 12 of the roller has a decreasing diameter, compared to the inner diameter of the body 2, where the smallest said diameter is of such a size that the bearing bush 6 can be easily inserted into the piston 1 and at the same time the roller 11 is prevented from falling out of the piston 1. The said portion 13 is preferably formed as a spherical zone, said fictive sphere which forms the said spherical zone comprises a diameter R which circumscribes the roller 11.

Another embodiment of the piston assembly according to the invention provides for that a crown 103 of a piston 101 is formed as a spherical segment to which is attached a cylindrical piston body 102. Also the inner surface of the piston 101 is entirely formed as a sphere, said fictive sphere having a diameter R. In the piston 101 there is arranged a bearing bush 106 which is formed as a spherical section and a roller 111 being placed in a bed 110 thereof. Here, the inner surface of the piston 101 is congruent with that side of the bearing bush 106 facing said piston.

With this embodiment an inner portion 113 of the piston body 102, located below a longitudinal axis 112 of the roller 111, is formed with the same diameter as the said inner spherical surface of the piston 102 and the outside spherical surface of the bearing bush 106. Since the lowermost edge of the piston 101 extends here far beyond the centre of the said fictive sphere, which is a sort of generatrix of both the inner surface of the piston and the outside surface of the bearing bush 106, the latter cannot be placed inside the piston 101 merely by advancing it in the longitudinal direction of the piston 101. In order to place the bearing bush 106 into the piston 101 it is necessary to tilt the bearing bush with respect to the inner portion 113 of the piston 101, and then to slip it over the inner surface of the piston 101 in its final position. The roller 111 is however prevented from falling out of the piston 101 since the diameter R of the said fictive sphere has such a size that it circumscribes the roller 111, and the centre of the roller 111 is way above the lowermost edge of the piston 101.

Figure 4:
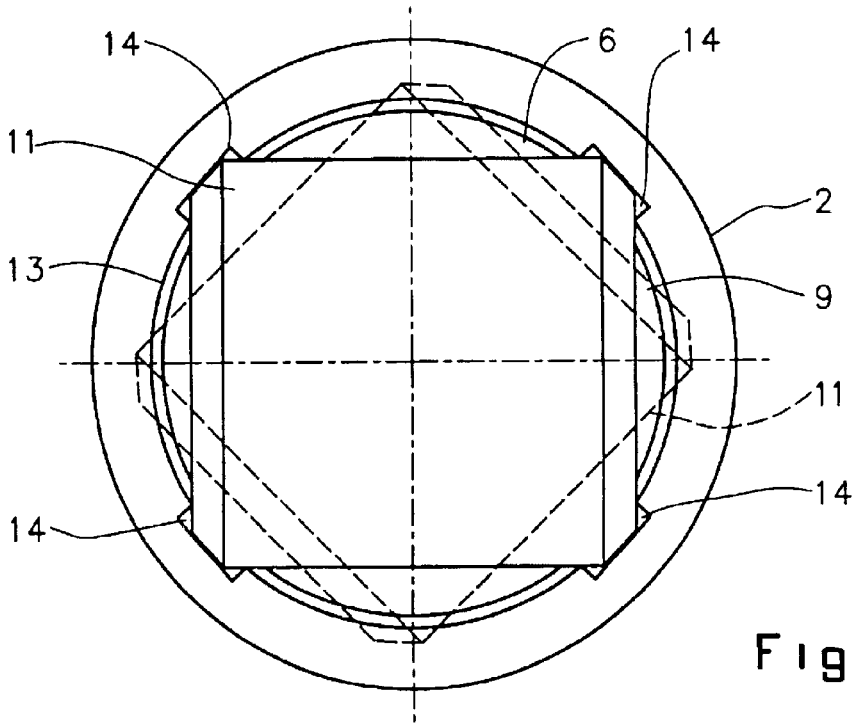
FIG. 4 is a piston assembly viewed from below.
Figure 2:
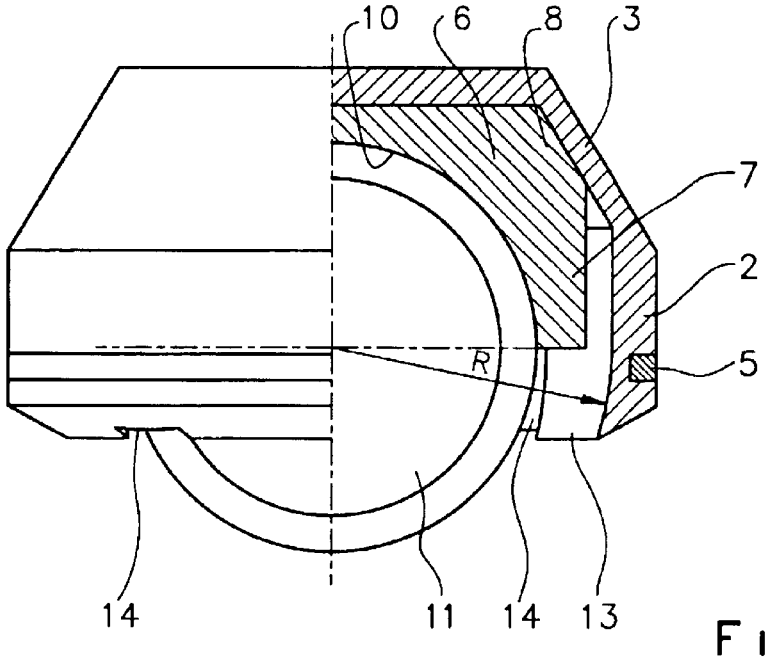
FIG. 2 is the first partial longitudinal section of the piston assembly.
Figure 3:
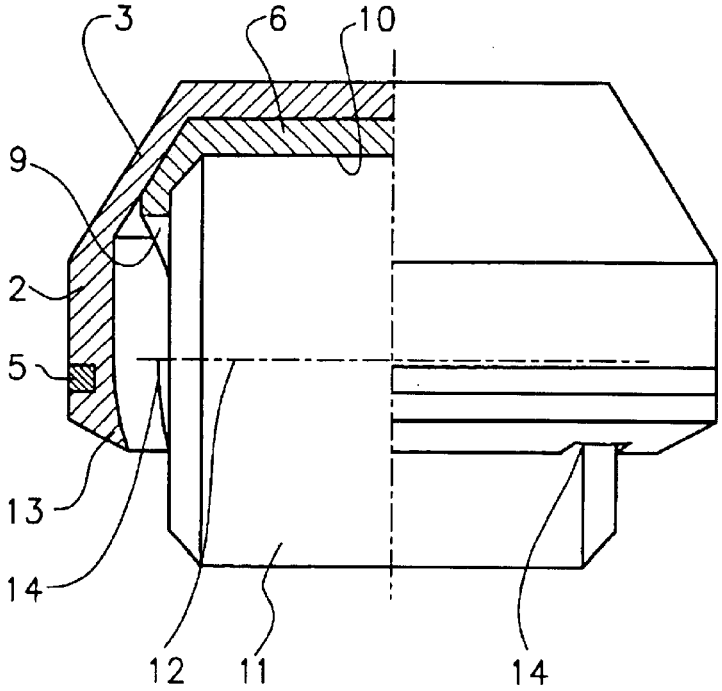
FIG. 3 is the second partial longitudinal section of the piston assembly, said section being perpendicular to that shown in FIG. 2.
Figure 5:
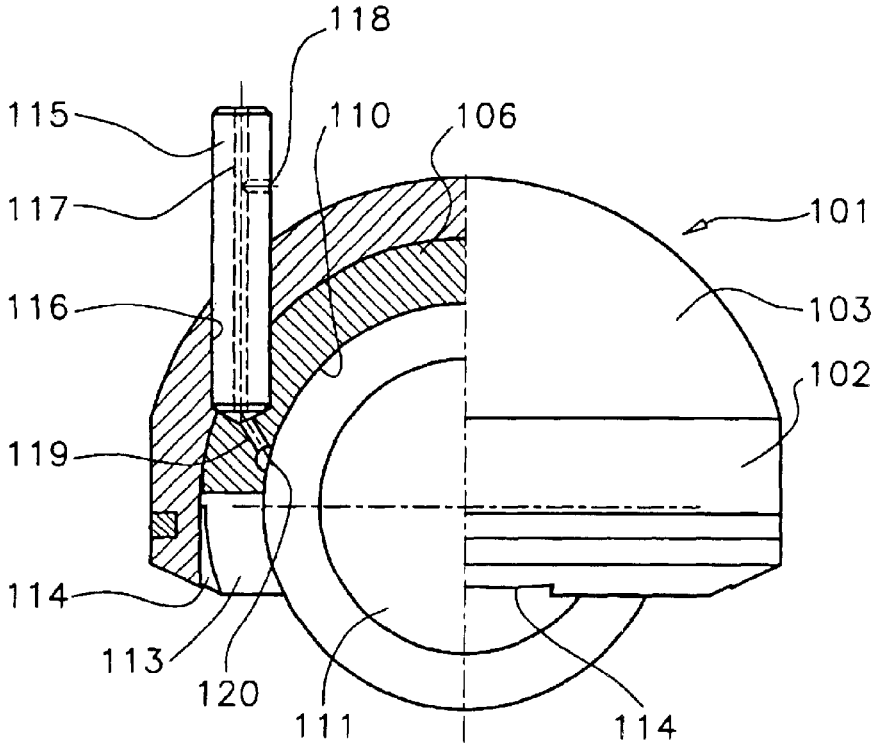
FIG. 5 is the first partial longitudinal section of the second embodiment of the piston assembly comprising means of preventing axial rotation.
Figure 6:
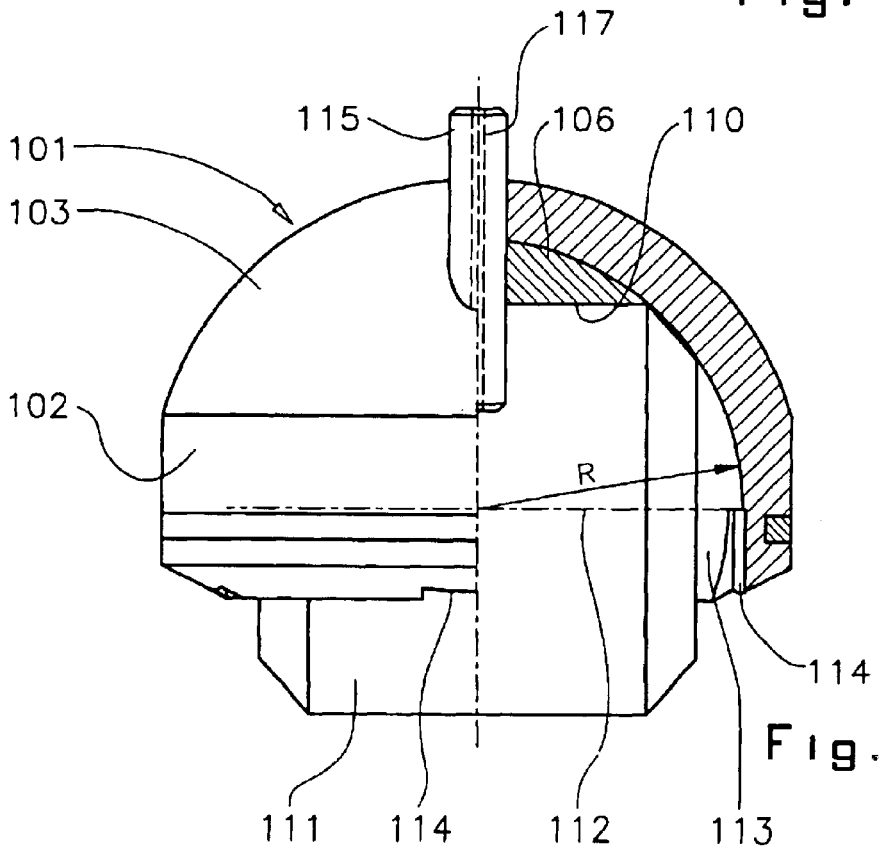
FIG. 6 is the second partial longitudinal section of the second embodiment of the piston assembly comprising means of preventing axial rotation.

In order to insert the roller 11; 111 easily into the piston 1; 101, the said lower inner portion 13; 113 of the body 2; 102 is provided with four grooves 14; 114 which extend in the longitudinal direction of the piston 1; 101 and which grooves coincide with the edges of the roller 11; 111 (FIG. 4). The said grooves 14; 114 are distributed in the inner circumference of the body 2; 102 and extend from the lowermost edge of the portion 13; 113 approximately to the centre-line of the roller 11; 111. In this way the insertion of the roller 11; 111 into the bed 10; 110 of the bearing bush 6; 106 is facilitated since the edges of the roller 11; 111 slip over the grooves 14; 114 into the interior of the piston 1; 101. The roller 11; 111 which is inserted into the bed 10; 110 of the bearing bush 6; 106, which is already placed inside the piston 1; 101, is rotated about the longitudinal axis of the piston 1; 101 so that the edges of said roller 11; 111 no longer mesh with the grooves 14; 114 (in FIG. 4 the rotated roller 11 is shown with a dashed line). Rotation, in a given case, corresponds to about 45 degrees. The bearing bush 6; 106 positioned in this way is now fixed against rotation as well as against longitudinal displacement, which is achieved by means of adhesive joint between the inner surface and the roof of the piston 1; 101, respectively, and the bearing bush 6; 106. Thus, the roller 11; 111 is kept inside the piston 1; 101 without any possibility of falling out.

Nevertheless, it is obvious that the number of the said grooves could be lower than four, e.g. two. In this latter case the two grooves which would be placed diametrically opposite would be formed in such a way that the roller with the both bases would slip through the said grooves into the interior of the piston. After all, the said lower portion of the piston could be formed even without said grooves. In this case it would be the roller which would be first inserted into the piston and afterwards the bearing bush. The latter is inserted in a manner so that it is seated with the roller bed on the roller which is already inserted into the piston, and then it is pushed over the spherical surface of the piston interior in order that it can turn about the longitudinal axis of the roller so as to come into the desired position. To facilitate the insertion, the bearing bush may be provided with two diametrically opposed chamfers.

The piston assembly according to the invention is secured against rotation about the longitudinal axis thereof by means of a guide pin 115 directed in the longitudinal direction of the motion of the piston assembly. On one side, the guide pin 115 is fixed in a receiving bore 116 which is formed as far as possible from the longitudinal centre-line of the piston assembly, and on the other side, it slides with a suitable amount of play in the guide bore in the body of the motor (not shown). Here, the bore 116 extends through the piston crown 103 and into the bearing bush 106. The guide pin 115 is provided with a through bore 117 extending longitudinally and, in the vicinity of the outer surface of the piston crown 103, with a transverse bore 118 which only extends to the bore 117. Here, the bearing bush 106 is provided with a connecting bore 119 which mutually links the roller bed 110 and the base portion of the receiving bore 116. The lubricant, i.e. a hydraulic oil in a given case, passes through the connecting bore 116 into one or more transverse lubrication grooves 120 provided in the roller bed 110 of the bearing bush 106. This way an additional forced lubrication of the roller 111 is allowed.

Multiple guide pins, e.g. two, may be provided for securing. In this case, the diametrically opposed guide pins must be placed in a way that the transverse centre-lines thereof do not coincide with the longitudinal axis of the roller.

While the forgoing written description of the invention enables one of ordinary skill to make and use what is considered presently to be the best mode thereof, those of ordinary skill will understand and appreciate the existance of variations, combinations, and equivalents of the specific exemplary embodiments and method herein. The invention should therefor not be limited by the above described embodiment and method, but by all embodiments and methods within the scope and spirit of the invention as claimed.

What is claimed is:

1. Piston assembly for a radial piston hydraulic motor comprising a piston (1), in which is arranged a bearing bush (6) with a bed (10) for a roller (11), a roller (11), and a piston ring (5) arranged in the outer portion of the piston (1), characterized in that a bearing bush (6; 106) is inserted into a one-part piston (1; 101), the latter comprising a cylindrical body (2; 102) and a crown (3; 103) attached thereto, the said crown provided, in a direction away from the cylindrical body (2; 102), with at least piecewise smoothly decreasing diameter, a roller (11; 111) is rotationally placed in a bed (10; 110) of the said bearing bush, a longitudinal axis (12; 112) of the said roller coincide in essence with the transverse axis through centre of gravity of the cylindrical piston body (2; 102), that the portion of the bearing bush (6; 106), facing the piston crown (3; 103), is congruent with the inner surface and the roof of the piston (1; 101), respectively, that an inner portion (13; 113) of the piston body (2; 102) located below the longitudinal axis (12; 112) of the roller (11; 111) in the direction away from the piston crown (3; 103) is provided with a decreasing diameter, and that the said inner portion (13; 113) of the piston body (2; 102) is formed with a number of grooves (14; 114) distributed circumferentially on the inner portion (13; 113) of the piston body (2; 102) the said grooves (14; 114) extending in longitudinal direction of the piston (1; 101) and coinciding with the edges of the roller (11; 111).

2. Assembly according to claim 1, characterized in that the bearing bush (106) is formed as a spherical segment with a diameter R of the fictive sphere which is a generatrix of the outside surface of the bearing bush (106).

3. Assembly according to claim 1, characterized in that the bearing bush (106) comprises a lower cylindrical portion (7) with the diameter which is smaller than the inner diameter of the piston (1), a through bore (9) is provided in the said cylindrical portion (7), extending perpendicularly to the longitudinal axis of the piston (1), and a portion (8) facing the piston crown (3), the said portion being congruent with the inner surface and the roof of the piston (1), respectively.

4. Assembly according to claim 1, characterized in that the inner surface of the piston (1; 101) and/or the said inner portion (13; 113) is spherical, the said fictive sphere which constitutes the said spherical zone has such a diameter R that it circumscribes the roller (11; 111).

5. Assembly according to claim 1, characterized in that the bearing bush (6; 106) and the roller (11; 1 11), which is rotationally arranged in the bed (10; 110) of the said bush, are secured against rotation about the longitudinal axis of the piston (1; 101) by means of an adhesive joint between the inner surface and the roof of the piston (1; 101), respectively, and the bearing bush (6; 106).

6. Assembly according to any of the preceding claims, characterized in that both the piston crown (3; 103) and the bearing bush (6; 106) are provided with a receiving bore (116), extending in the longitudinal direction of the piston assembly, in which bore is fixed a guide pin (115).

7. Assembly according to any of claims 1–5, characterized in that the guide pin (115) is provided with a longitudinal through bore (117), and with a transverse bore (118) lying outside the receiving bore (116), and that the bearing bush (6; 106) is provided with a connecting bore (119) mutually linking the roller bed (10; 110) and the base portion of the receiving bore (116).

8. Assembly according to claim 6, characterized in that the guide pin (115) is provided with a longitudinal through bore (117), and with a transverse bore (118) lying outside the receiving bore (116), and that the bearing bush (6; 106) is provided with a connecting bore (119) mutually linking the roller bed (10; 110) and the base portion of the receiving bore (116).

* * * * *